United States Patent [19]

Dorner

[11] Patent Number: 4,650,350

[45] Date of Patent: Mar. 17, 1987

[54] METHOD AND APPARATUS FOR THERMAL PRINTING OF PLASTIC CARDS

[75] Inventor: Frank Dorner, Vienna, Austria

[73] Assignee: Kunz AG, Vienna, Austria

[21] Appl. No.: 704,681

[22] Filed: Feb. 22, 1985

[30] Foreign Application Priority Data

Feb. 23, 1984 [DE] Fed. Rep. of Germany ..... 3406470

[51] Int. Cl.[4] ..... B41J 3/10

[52] U.S. Cl. ..... 400/120; 346/76 PH; 101/426

[58] Field of Search ..... 400/120; 346/76 PH; 219/216 PH; 101/21, 426

[56] References Cited

U.S. PATENT DOCUMENTS

| | | | |
|---|---|---|---|
| 3,354,817 | 11/1967 | Sakurai et al. | 400/120 X |
| 3,605,976 | 9/1971 | Angle | 101/21 X |
| 4,000,393 | 12/1976 | Cochran et al. | 346/76 PH X |
| 4,030,588 | 6/1977 | Hanagata et al. | 400/120 |
| 4,039,065 | 8/1977 | Seki et al. | 346/76 PH X |
| 4,063,500 | 12/1977 | Abe | 101/27 X |
| 4,394,092 | 7/1983 | Osmera et al. | 400/120 |
| 4,422,376 | 12/1983 | Teraoka | 400/120 X |

*Primary Examiner*—Clifford D. Crowder

*Attorney, Agent, or Firm*—Flynn, Thiel, Boutell & Tanis

[57] ABSTRACT

A printing device for the production of tamper-proof printing on print receiving material comprises a printing head which carries individually controllable heating elements and a color transmitting embossing foil.

13 Claims, 6 Drawing Figures

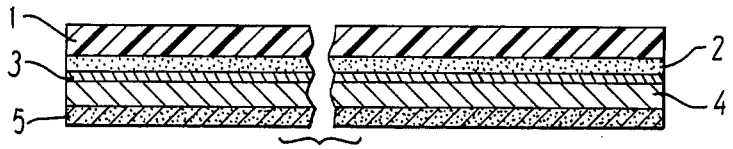
FIG. 1
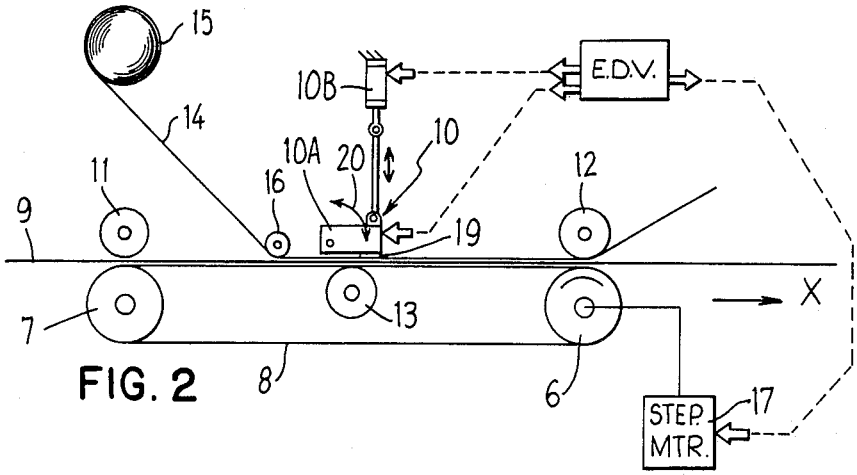
FIG. 2
FIG. 3A
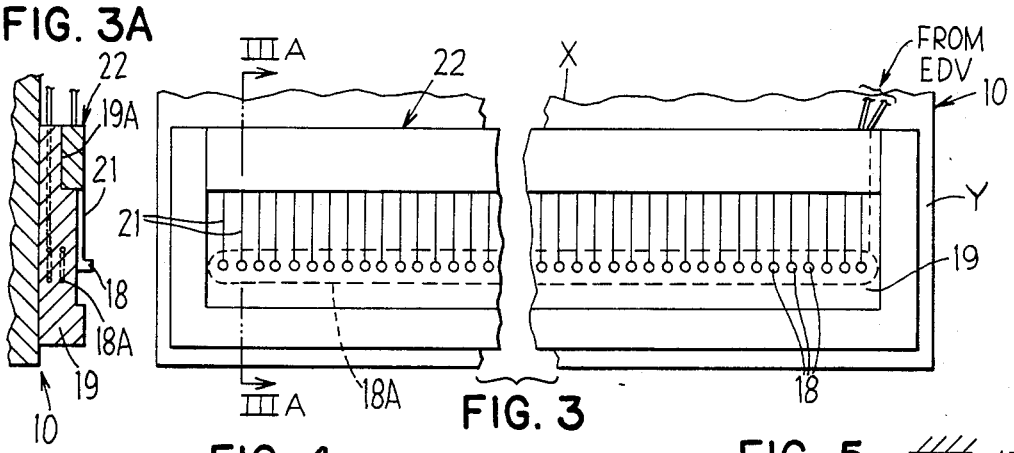
FIG. 3
FIG. 4
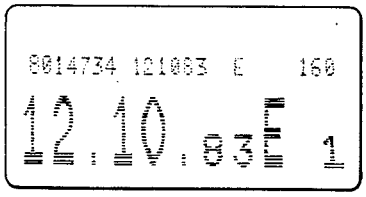
FIG. 5
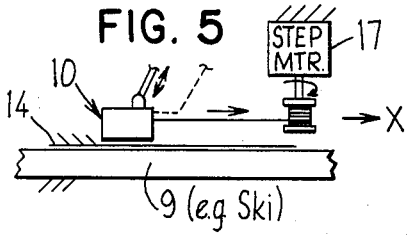

METHOD AND APPARATUS FOR THERMAL PRINTING OF PLASTIC CARDS

FIELD OF THE INVENTION

The invention relates to the use of an embossing foil for printing on plastic surfaces, in particular on plastic cards.

BACKGROUND OF THE INVENTION

For the tamper-proof personalization of identification cards, authorization cards, like check cards or credit cards and the like, of plastic it is known to use printing devices with positive embossing types, with which the suitable person-related alphanumeric data are embossed into the cards, so that they by embossing project raised from the front side of the card or by embossing are sunk into the front side of the card exist as recesses.

In the first case, generally after the embossing a coloring of the raised projecting data with an embossing foil is carried out additionally. The design and function of such an embossing foil will be discussed in greater detail hereinafter. In the latter case a color tape for coloring the data can be fed to the printing device during embossing.

In the described known type of the personalization only the letter and number types which exist in the printing device can be printed. Also the speed during printing with embossing types is known to be limited. The machines which are needed for this are mechanically very complicated, susceptible to repairs and expensive.

Furthermore, it is not possible to provide in the area of the card, which area is provided for the embossing, a magnetic tape which is provided with magnetically readable data, which tape today often exists in the case of identification and authorization cards. Such a magnetic tape would namely be destroyed during embossing of the data. The same is true for cards incorporating integrated microcircuits (IC's), since these generally extend at least over a large portion of the card surface. Cards which are provided with IC's can therefore not at all be printed on with the described known printing methods.

Also it is known to use identification and authorization cards with a paper layer between the plastic carrier layer and a protective foil and to color the paper layer with a program-controlled laser beam. With this it is possible to not only produce preselected letters and numbers, but it is also possible to vary the size of the letters and numbers or to draw (print) Chinese or Arabic letterings or pictures. However, devices which operate with a laser beam are extremely expensive. Moreover, they also are hardly suitable for the manufacture of cards which are provided with an IC.

In order to make possible a quick reproduction of data in modern data processing and data transfer, so-called thermoprinters have been developed. These have a printing head, which is brought into contact with a paper which is coated with a thermosensitive color. Thermoprinters have the advantage, that with them it is not only possible to print predetermined letters and numbers, but for example also pictures, letters and numbers of different size and letter type and Chinese and Arabic letterings.

The known thermoprinters work usually according to the principle of a dot printer, in which a plurality of dots combined result in the sign to be printed. For this purpose, the printing head has a plurality of heating elements, which are arranged in a row and print out said dots. The thermosensitive printing paper moves thereby at a right angle with respect to the heating element row. The heating elements are individually controlled, so that the color of the thermosensitive paper changes only at the controlled heating elements. In this manner the desired pattern is printed on the paper. Such a thermo-printing head is described for example in the brochure "Introduction to Thermal Print Head Technology" of the Firm Rohm.

However, these thermoprinters are not suited for the personalization of identification and authorization cards. The thermosensitive paper is namely neither resistant to ultra violet light (UV) nor chemicals, so that it changes color in time. Also, pressing on of a protective layer is not possible because of the increased temperature which it requires. Furthermore, the thermosensitive layer can hardly be printed on with a visible color, although such is often desired for nonchangeable data, for example, data not person-related.

From German OS No. 2 315 226 a color tape for a thermoprinter is known, which consists of a carrier foil and a layer of a mixture of a resin and a coloring substance and is designated for printing on paper. In order to print by using such color tapes on plastic surfaces with a thermo-printing head, it is known to provide the color layer with a sublimable coloring substance, whereby the released color dot is exposed to an infrared source irradiating the plastic surface, in order to permit it to penetrate into the plastic surface (Brochure "A new method of non-impact printing", Page 10, of the Firm Armor S.A., Nantes, France). The arrangement is relatively expensive due to the special color tape and the infrared source and moreover permits only a relatively slow printing.

Known also are so-called embossing foils. These are composite foils, which consist of a carrier foil, for example a polyester foil with a separating layer which in general contains wax, a color layer which follows the separating layer and a thermoreactive adhesive layer which follows the color layer, whereby between separating layer and color layer there is usually additionally provided a lacquer protective layer.

The embossing foils are pressed on with hot embossing presses (so-called hot stamping) with a pressure of several 100 kg (kilograms) or even several tons, as can be taken for example from the brochure "Praegefolien Programm" (Embossing foils program), last page, of the Firm Leonhard Kurz, Fuerth, of May 1978. The adhesive layer is thereby activated, so that a separation of the composite foil at the separating layer is brought about, whereby the carrier foil is removed and the color layer, which, if desired, is provided with a lacquer protective layer, adheres to the respective goods.

Such embossing foils are used for many different purposes. Due to their excellent adhesive capability they are utilized for example for coating of motor-vehicle bumpers or of bathtubs. Also they are used to print on different materials, like paper, leather, wood etc. The printing is done thereby with a printing stamp, which can be heated up to the activating temperature of the adhesive, as a printing block.

It is known from German OS No. 1 449 637 to arrange side-by-side several printing stamps, which correspond with such printing blocks and which are selectively movable in order to receive the high pressure which is necessary when using an embossing foil, in order to apply letters on any type of carriers. The known stamp arrangement has, however, substantially the same disadvantages as the embossing devices which have been described in the beginning, namely the printing speed is low, the required printing device is mechanically complicated, susceptible to repair and expensive and the sign storage (character inventory) is limited by the number of printing stamps.

The basic purpose of the invention is to print on plastic surfaces by means of a simply designed printing arrangement quickly and as much as possible tamper-proof. This purpose is attained inventively by using an embossing foil as a color-transmitting material for a device for printing on plastic surfaces with a thermo-printing head which has individually controllable heating elements.

A commercial thermo-printing head can be used in the present invention. The cost of the printing devices usable in the present invention are thus reduced substantially compared with the aforedescribed conventional devices for tamper-proof printing on plastic surfaces, in particular of identification or authorization cards of plastic. Also, under the present invention the high printing speed of the thermo-printing head is utilized, namely for example check cards can be personalized in a few seconds.

Commercial embossing foils can also successfully be utilized as embossing foils, for example the embossing foils of the Firm Leonhard Kurz, Fuerth. These may be metal foils, in which as a carrier layer is used for example polyester film and as metal vapor deposited high-purity aluminum is used. Further suitable metal foils are for example pure gold foils, chromium foils or bronze foils. Also color foils, imitation gold foils etc. are suitable.

In view of the high pressures needed for pressing on of embossing foils with stamping presses, it is surprising that it is possible to obtain a satisfactory print on a plastic surface with an embossing foil and a thermo-printing head, which permits only a relatively moderate pressure.

The reason for this unexpected result should lie in that in spite of the short control time the heating elements are heated to a relatively high temperature, which causes an explosionlike expansion of the carrier foil at the respective contact points. Through this an additional printing component is applied onto the transferring color dot and thus an intimate connection of the same with the plastic surface is created.

In order to guarantee good temperature transmission from the heating elements of the thermo-printing head to the embossing foil or the adhesive layer, a planar support is necessary for the material to be printed on.

For the same reason it is necessary that the material to be printed on has the same thickness at least transversely to the transport direction. Also the peak-to-valley height of the material to be printed on should be below 10 $\mu$m. Otherwise the time of contact and/or the pressure of the printing head must be increased.

Since the heating elements of the thermo-printing head can be controlled individually by a conventional electronic data processor device (e.g. a programmable microprocessor), or EDV, it is possible with the inventive device to create any desired printed works, that is, not only alphanumeric data but for example also pictures or bar codes. Also it is possible to choose at random the color of the embossing foil and thus of the print.

As mentioned above, the embossing foils which are available in commerce have such great adhesion that they are used today even for highly stressed structural parts, like motor-vehicle bumpers. This high adhesion is also fully utilized according to the invention and results in a correspondingly high tamper-proof security of the inventively manufactured printed work.

Furthermore, it is also possible under the invention to print in tamper-proof manner on the entire surface of identification or authorization cards which are provided with a magnetic tape or an IC.

BRIEF DESCRIPTION OF THE DRAWINGS

The invention will be described in greater detail hereinafter in connection with the enclosed drawing, in which:

FIG. 1 is a cross-sectional view of a commercial embossing foil in a considerably enlarged illustration;

FIG. 2 schematically illustrates an embodiment of a printing device according to the present invention;

FIG. 3 is a bottom view of a thermo-printing head of the FIG. 2 device, in a considerably enlarged, schematic illustration;

FIG. 3A is a fragmentary sectional view taken substantially on the line IIIA—IIIA of FIG. 3;

FIG. 4 illustrates a card which has been printed according to the invention with alphanumeric data.

FIG. 5 is similar to FIG. 2 but shows a modification.

DETAILED DESCRIPTION

FIG. 1 shows a commercial embossing foil formed by a composite foil, which comprises a carrier layer 1, for example of polyethylene, a separating layer 2, for example of wax or a waxlike material, a lacquer layer 3, a color layer 4 and an adhesive layer 5 which can be thermoactivated, for example at a temperature of approximately 110° C.

If a pressing tool heated up to, for example, 120° C. is pressed onto the carrier layer 1, then the adhesive layer 5 is activated, which causes it to connect the color layer 4 (Covered by the protective lacquer layer 3) to the material to be printed on, while the carrier foil 1 is released therefrom due to the softening of the wax layer 2.

The printing device of FIG. 2 has, for example, a conveyor belt 8 which rotates about rollers 6 and 7, on which conveyor belt the material 9 to be printed on, for example check cards, is fed to the thermo-printing head 10. If the cards have a magnetizable carrier (for example a magnetic tape), the desired data can be previously recorded magnetically onto such check cards.

Furthermore two pressure rollers 11 and 12 are provided, which press the material 9 to be printed on fixedly against the conveyor belt 8. An opposing pressure roller 13 is arranged directly under a printing head 10 and during printing holds the material 9, which is to be printed on and which lies on the conveyor belt 8, against the underside of the thermo-printing head 10.

The embossing foil 14 is unwound from a feed roller 15 and is fed by a guide roller 16 onto the material 9 to be printed on, just ahead of the printing head 10. The roller 6, which drives the conveyor belt 8, is in turn driven by a stepping motor 17.

The stepping motor 17 is arranged such that it carries out, for example, three steps per one millimeter of transport of the material 9 to be printed on.

FIG. 3, shows a printing head 10 which has at its underside a row of heating elements 18. Such row extends over the entire printing width and extends transversely to the transport direction of the material 9. The heating elements 18 may be resistors, which are mounted on a ceramic substrate 19. The distance between adjacent heating elements 18 is for example 0.3 mm., measured from the center of one heating element 18 to the center of the next heating element 18.

The heating elements 18 are connected to a microcircuit in the form of a microchip, schematically indicated at 22, through conductor paths 21 which are vapor deposited onto the ceramic substrate 19. The microchip 22 has a thickness greater than the projection of the heating elements 18 from the ceramic substrate 19, which projection is approximately 0.3 to 0.4 mm. Thus, a flat plate of rigid or difficult to flex material, in particular a plastic card, could not be brought into contact with the heating elements 18, if the microchips 22 and the heating elements 18 both were supported on a one plane surface of the ceramic substrate 19.

In order to create the required contact between the heating elements 18 and a nonbendable or difficult to bend card, the thermo-printing head 10 is preferably designed such that the heating elements 18 form the farthest projecting areas on the underside of the thermo-printing head 10, namely so that the heating elements 18 project farther from the ceramic substrate 19 than the microchip 22. This can for example be achieved by arranging the microchip 22 in a recess 19A in the ceramic substrate 19 or by arranging the microchip on a surface of the ceramic substrate 19, which surface defines an angle with the plane of the underside of the thermo-printing head, on which are provided the heating elements 18. Such angle is preferably less than 90°, in order to prevent sharp edges for the conductor paths 21 to cross.

The heating elements 18 reach the temperature of for example 120° C., which temperature is needed for the activation of the adhesive layer 5, at a current in the range of 1 mA (milliamperes), in a few ms (milliseconds).

The heating elements 18 can be controlled with an EDV-system (electronic data processing device) of conventional kind. The printing head 10 can be pivoted about an axis 10A which extends transversely of the transport direction, or parallel to the row of heating elements 18, as indicated by the arrow 20 in FIG. 2, to swing toward or away from the conveyor belt 8 or the material 9 which lies thereon. Conventional motor means 10B, such as a pressure fluid cylinder, can be used to press the printing head 10 against the material 9 to be printed on and alternatively to lift the printing head 10 away from the material 9. In this manner during printing the printing head is pressed, in the time between successive material transport steps, against the material 9 to be printed on and such pressure is relieved during transport of the material 9 by the conveyor 8. Also the printing head pressure can be relieved when the heating elements 18 are not energized. The control of the device 10B by which the printing head 10 is pressed against the material 9 to be printed on, occurs also by means of the EDV-system.

The printing device which is illustrated in FIGS. 2 and 3 can write in two coordinates. The x-coordinate extends in the transport direction of the material 9 to be printed on, and the y-coordinate extends at a right angle thereto. The data for the x-coordinate, thus the time raster, consists of one bit. The data for the y-coordinate, based on which the EDV-system selects the heating elements 18 which are to be activated, consists of several bits. The control and timing of the transport of the printing receiving material 9 is done with the x-bit in such a manner that after the setting of the x-bit the motor 17 moves the printing receiving material 9 a distance, for example 0.3 mm., past the printing head 10. As mentioned, the device 10B, which presses the printing head 10 against the material 9, is actuated in the time interval between two successive transport steps. Those of the heating elements 18 which are to be activated are at the same time actuated under control of the y-bits and thus heat up. Each actuated heating element 18 results in a dot-shaped activation of the adhesive layer 5 and thus in fixing of a corresponding dot of the color layer 4 onto the opposed material 9. The size of the distance between adjacent heating elements 18 and the size of the transport steps in x-direction determines the raster (grid) density of the dots forming the printed characters (signs) produced by the inventive device.

Since the printing head 10 presses the embossing foil 14 against the print receiving material 9, it is not necessary to provide a separate transport mechanism for the embossing foil 14 in the device.

The printing head 10 can be preheated, for example, by means of a conventional resistance heating coil 18A to a constant temperature of 110° C., thus to 10° C. below the activating temperature of the adhesive layer 5 of the foil 14. This reduces the heating-up time of the heating elements 18 and makes possible a quick and even printing.

FIG. 4 illustrates a plastic card on which has been printed alphanumeric data by means of the inventive apparatus.

Furthermore, in place of the stationary printing head 10 shown in FIG. 2 it is possible instead to make the printing head 10 movable stepwise along the axis over the stationary print receiving material 9 and embossing foil 14, which for example is advantageous for printing on large articles. For example this embodiment of the invention can be used in printing on skis in order to apply for example variable data, like the serial number for that pair of skis, a bar code, etc.

The embodiments of the invention in which an exclusive property or privilege is claimed are defined as follows:

1. A printing device for the production of tamperproof printing on a plastic surface, comprising:

a thermal, nonimpact, nonembedding printing head of the kind which carries dot printing elements which are individually selectively heated and nonheated dot printing elements for printing part of a character to be printed;

a color transmitting embossing foil and means interposing said embossing foil between said selectively heated and nonheated dot printing elements and the plastic surface to be printed; and low pressure pressing means engageable with said printing head for pressing, by selectively heated and nonheated dot printing elements, of said foil against said plastic surface to be printed.

2. A printing device according to claim 1, wherein the dot printing elements of the printing head form at least one row which extends transversely to the direction of movement of the plastic surface with respect to the printing head.

3. A printing device according to claim 2, wherein the distance between two adjacent dot printing elements of one row is in the range from 0.1 to 1 mm.

4. A printing device according to claim 1, including a stepwise driven transport means for advancing the plastic surface in partial character increments.

5. A printing device according to claim 1, including a transport means for moving the printing head stepwise along a stationary length of plastic surface in partial character increments.

6. A printing device according to claim 1, including transport means for relatively advancing one of said printing head and plastic surface with respect to the other thereof, the pressing means for pressing the dot printing elements against the foil being actuable in the time between successive transport steps.

7. A device according to claim 1, in which the low pressure pressing means press the printing head with a pressure of at least 0.2 kg./cm$^2$ against the foil and plastic surface during printing.

8. A device according to claim 1, wherein the printing head has a surface which faces the embossing foil and plastic surface, the heating elements being on said printing head surface and projecting the farthest from said printing head surface of any other elements on said printing head surface.

9. A device according to claim 1, wherein the embossing foil has a thermo-reactive adhesive layer and the printing head is preheated to a constant temperature, less than 15° C. below the activating temperature of the thermo-reactive adhesive of the embossing foil.

10. A device according to claim 1, in which said dot printing elements are heating elements which are controllable individually.

11. A printing device according to claim 1, wherein the dot printing elements of the printing head comprise heating elements which form at least one row which extends transversely to the direction of movement of the print receiving material with respect to the printing head and the distance between two adjacent heating elements of one row is in the range from 0.1 to 1 mm, transport means for relatively advancing one of said printing head and print receiving material with respect to the other thereof, the pressing means for pressing the dot printing elements against the foil being actuable in the time between successive transport steps, in which the low pressure pressing means press the printing head with a pressure of at least 0.2 kg./cm$^2$ against the foil and plastic surface during printing, the printing head having a surface which faces the plastic surface, the heating elements being on said printing head surface and projecting the farthest from said printing head surface of any other elements on said printing head surface, the color transmitting embossing foil being of the kind conventionally used with block type in high pressure hot stamping presses, said foil being a composite foil of the multilayer kind including a carrier layer, a heat softenable separating layer, a color layer separable from said carrier layer upon softening of said separating layer, and a thermoreactive adhesive layer in that order, said foil being interposed between said dot printing elements and said plastic card with said carrier layer facing said heated elements and said thermoreactive adhesive layer engaing said plastic card, the printing head being preheated to a constant temperature less than 15° C. below the activating temperature of the thermoreactive adhesive of the embossing foil, said heating elements being controllable individually.

12. A high speed, thermal, printing system for the production of tamperproof printing on plain, unembossed surfaces of plastic cards, including plastic cards of the kind carrying a magnetically readable data tape or an integrated microcircuit, the system comprising:

a color transmitting embossing foil of the kind conventionally used with block type in high pressure hot stamping presses, said foil being a composite foil of the multilayer kind including a carrier layer, a heat softenable separating layer, a color layer separable from said carrier layer upon softening of said separating layer, and a thermoreactive adhesive layer in that order;

means for tamperproof heat affixing dots of said color layer of said embossing foil to the plain unembossed surface of a plastic card in any desired spacial arrangement with low heat expenditure and pressure, said means comprising a nonimpact, nonembedding printing head of the kind from which protrude dot printing elements which are individually selectively heated for printing part of a character to be printed;

means for supporting the plastic card to be printed on;

means for interposing said embossing foil between said dot printing elements and the plastic card on said supporting means with said carrier layer facing said dot printing elements and said thermoreactive adhesive layer engaging said plastic card;

means relatively stepwise advancing said plastic card supporting means and printing head for progressively printing of dot matrix characters on said plastic card;

low pressure pressing means engaging said printing head and actuable between advancing steps for pressing by said selectively heated and nonheated dot printing elements of said foil against the pastic card, and the heated ones of said dot printing elements having means for directly heat activating dots of said adhesive layer, heat softening opposed dots of said separating layer and transferring corresponding dots of said color layer from said foil fixedly onto the plastic card.

13. A method for high speed, thermal, tamperproof printing on plain, unembossed surfaces of plastic cards, including plastic cards of the kind carrying a magnetically readable data tape or an integrated microcircuit, comprising the steps:

supporting the plastic card to be printed on;

providing a color transmitting embossing foil of the kind conventionally used with block type in high pressure hot stamping presses, said foil being a composite foil of the multilayer kind including a carrier layer, a heat softenable separating layer, a color layer separable from said carrier layer upon softening of said separating layer, and a thermoreactive adhesive layer in that order;

supporting opposite said plastic card a nonimpact, nonembedding printing head of the kind from which protrude dot printing elements which are individually selectively heated for printing part of a character to be printed;

interposing said foil between said dot printing elements and the plastic card with said carrier layer facing said dot printing elements and said thermoreactive adhesive layer engaging said plastic card;

tamperproof heat affixing dots of said color layer of said embossing foil to the plain unembossed surface of the plastic card in any desired spacial arrangement with low heat expenditure and pressure, by selectively heating desired ones of said dot printing elements and pressing said head at low pressure toward said foil, and therewith pressing by said selectively heated and nonheated dot printing elements of said foil against the plastic card, and with the heated ones of said dot printing elements directly heat activating dots of said adhesive layer, heat softening opposed dots of said separating layer and transferring corresponding dots of said color layer from said foil fixedly onto the plastic card;

between pressing steps relatively stepwise advancing said plastic card and printing head for progressively printing of dot matrix characters on said plastic card.

* * * * *